US008961015B1

(12) United States Patent
Bihn

(10) Patent No.: US 8,961,015 B1
(45) Date of Patent: Feb. 24, 2015

(54) ANTI-SLIP ELECTRONIC DEVICE SLEEVE

(71) Applicant: Tom Bihn Incorporated, Seattle, WA (US)

(72) Inventor: Thomas Damien Bihn, Port Angeles, WA (US)

(73) Assignee: Tom Bihn, Incorporated, Seattle, WA (US)

( * ) Notice: Subject to any disclaimer, the term of this patent is extended or adjusted under 35 U.S.C. 154(b) by 141 days.

(21) Appl. No.: 13/875,728

(22) Filed: May 2, 2013

(51) Int. Cl.

| | |
|---|---|
| ***B65D 30/08*** | (2006.01) |
| ***B65D 33/14*** | (2006.01) |
| ***B65D 30/22*** | (2006.01) |
| ***B65D 33/00*** | (2006.01) |

(52) U.S. Cl.
CPC ..... *B65D 29/02* (2013.01)
USPC ..... 383/109; 383/22; 383/40; 383/95; 383/105; 383/116

(58) Field of Classification Search
USPC ..... 383/109, 116, 105, 22–24, 40, 95
See application file for complete search history.

(56) References Cited

U.S. PATENT DOCUMENTS

| | | | | |
|---|---|---|---|---|
| 2,650,700 | A * | 9/1953 | Wolf | 206/5 |
| 4,081,864 | A | 4/1978 | Liman | |
| D375,197 | S | 11/1996 | Laherty | |
| 6,121,544 | A * | 9/2000 | Petsinger | 174/353 |
| 6,435,236 | B2 * | 8/2002 | Gribovsky | 150/137 |
| 6,581,760 | B1 | 6/2003 | Robertson | |
| D533,347 | S | 12/2006 | Andre | |
| D606,312 | S | 12/2009 | Lown | |
| D610,809 | S | 3/2010 | Lown | |
| 8,272,507 | B1 * | 9/2012 | Crump et al. | 206/223 |
| D670,497 | S | 11/2012 | Phillips | |
| 8,550,713 | B2 * | 10/2013 | Schwarz | 383/35 |
| 2002/0125148 | A1 * | 9/2002 | Anderson et al. | 206/5 |
| 2005/0161352 | A1 * | 7/2005 | Huddleston | 206/320 |
| 2005/0263418 | A1 | 12/2005 | Bastus | |
| 2007/0199855 | A1 * | 8/2007 | Lim | 206/523 |
| 2008/0245373 | A1 | 10/2008 | Kounkel | |
| 2009/0194444 | A1 * | 8/2009 | Jones | 206/320 |
| 2010/0147716 | A1 * | 6/2010 | Jones | 206/320 |
| 2011/0210020 | A1 * | 9/2011 | Jones | 206/216 |
| 2012/0260611 | A1 * | 10/2012 | Jones | 53/468 |

FOREIGN PATENT DOCUMENTS

| | | | | |
|---|---|---|---|---|
| JP | 2000224279 | A * | 8/2000 | H04M 1/02 |
| JP | 2001329415 | A * | 11/2001 | A41D 27/20 |

* cited by examiner

*Primary Examiner* — Jes F Pascua
(74) *Attorney, Agent, or Firm* — Virginia P. Shogren

(57) ABSTRACT

A fabric-based electronic device sleeve with a stiff directional nap lining the interior of a pocket. The directional nap (or plush) of the fabric is oriented to permit easy slidable insertion of an electronic device into the sleeve's pocket, with static friction forces between the directional nap and the device preventing the device from slipping out on its own or falling from the sleeve when held in a downward direction. As a user removes the electronic device from the sleeve, a gentle pull upon pinching the device between thumb and index finger overcomes the static friction forces between the device and the directional nap lining to permit easy removal and access.

15 Claims, 3 Drawing Sheets

14
14'
16
16'
18
22
26
28
30
32
34
F

ANTI-SLIP ELECTRONIC DEVICE SLEEVE

FIELD OF THE INVENTION

This invention relates generally to protective fabric-based covers for communication devices, and more particularly to an open sleeve having opposing internal layers of material with a stiff directional nap capable of engaging the smooth faces and contours of an electronic device to keep the device from falling out of the sleeve even when the open sleeve is held in a downward direction.

BACKGROUND OF THE INVENTION

Users of small electronic devices, such as cellular phones, smart phones, tablet computers, and the like, need to protect the devices when not in use. The users also need to access the devices quickly, such as when a telephone rings, or a text message is sent to the device, and the user needs to remove the device from the sleeve to answer the call or read a message.

A typical sleeve design for these small electronic devices includes a fabric-based sleeve into which the device is slidably inserted. Most of these sleeve designs include a flap over the sleeve opening, secured by hook and loop fastener or other fasteners to safely retain the device within the sleeve. These flaps and other fasteners take time to open and close, and impede access to the device.

Consequently, whereas sleeves have been developed to provide protection for small, hand-held electronic devices, these sleeves exhibit one or more drawbacks that make them unsuitable. The drawbacks include: 1) fasteners over, around, or across the sleeve opening to retain the device within the sleeve; and, 2) open sleeve designs that do nothing to retain the electronic device within the sleeve when the sleeve is tipped or turned in a downward direction, thereby allowing the device to fall out of the sleeve and suffer damage.

Accordingly, there is an as of yet unmet need in the art for an electronic device protective sleeve that: 1) does not include a fastener over, around, or across the sleeve opening that impedes access to the device; and, 2) does not permit the device to fall out of the sleeve when the sleeve is tipped or turned in a generally downward direction.

THE INVENTION

Summary of the Invention

The inventive Anti-Slip Electronic Device Sleeve of this application protects electronic communication devices having a defined shape and generally smooth external contoured faces and edges. The sleeve comprises a top margin defining a first slot opening on a first end, a closed base margin on an opposing second end, and side walls generally spanning the first and second ends, said walls having an internal defined length. The sleeve is constructed primarily of one or more fabrics, said fabrics comprising a first external layer of material and a second internal layer of material. A maximum width of the slot opening, a maximum depth of the slot opening, and the internal defined length of the side walls generally conform to the defined shape of the device and define a pocket shaped for slidable insertion and removal of the device from within the pocket. The second internal layer of the material comprises a stiff, directional nap capable of engaging the smooth contoured faces and edges of the device inserted within the sleeve when the sleeve is held in a downward direction.

BRIEF DESCRIPTION OF THE DRAWINGS

The invention is described in more detail with reference to the attached drawings, in which.

DETAILED DESCRIPTION OF THE ILLUSTRATIVE EMBODIMENT

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the diagrams show in schematic, or omit, parts that are not essential in that diagram to a description of a particular feature, aspect or principle of the invention being disclosed. Thus, the best mode embodiment of one feature may be shown in one diagram, and the best mode of another feature will be called out in another diagram.

Anti-Slip Electronic Device Sleeve

In general terms, the Anti-Slip Electronic Device Sleeve comprises fabric with a stiff directional nap (similar to natural or synthetic sealskin) lining the interior of a pocket. The directional nap (or plush) of the fabric is oriented in such a way that it allows an item, such as a cell phone or other small electronic device, to slide easily into the sleeve or pocket, but be less inclined to slip out. As a user removes the electronic device from the sleeve, pinching the device (e.g., cell phone) between thumb and index finger substantially disengages the napped material from the surface of the device and overcomes the static friction between the device and the stiff directional nap to permit easy removal from the sleeve.

Figure 1:
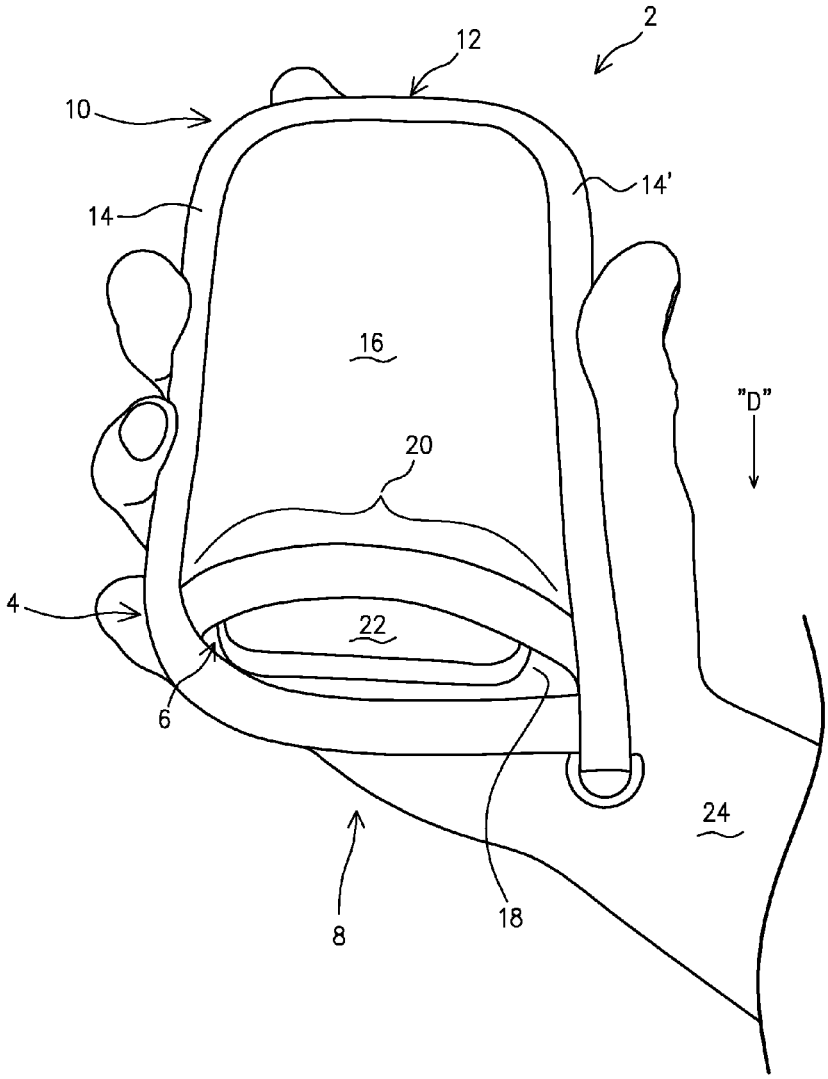
FIG. 1 is a front elevation view drawing of the inventive Anti-Slip Electronic Device Sleeve containing an exemplary electronic device held by a user in a downward direction with electronic device retained within the open sleeve, according to the invention.

FIG. 1 shows the inventive Anti-Slip Electronic Device Sleeve 2 containing an exemplary electronic device 22 held by a user 24 in a downward direction (arrow "D") with electronic device 22 retained within the open sleeve 2. Referring to FIG. 1, the sleeve 2 comprises top margin 4 having an open first end 8 defining a slot opening 6, and an opposing, closed second end 12. Fabric 16 external walls of the sleeve span the first and second ends 8/12 and extend between opposing side walls 14/14'.

The internal fabric layers 18 have a stiff directional nap, as further described in connection with FIGS. 2-3C, infra. The width 20 of the slot opening 6 generally conforms to the width of the device 22 slidably inserted within the sleeve 2. When the sleeve 2 is held in a downward direction (arrow "D"), the device 22 does not fall out of the sleeve 2; rather, the stiff directional nap 18 engages the smooth contours of the device 22 to retain the device 22 in position within the sleeve 2.

Referring again to FIG. 1, the sleeve 2 is constructed to conform to the shape of any desired electronic device 22, including without limitation, cell phones, smart phones, media players, tablet computers, and the like.

Figure 2:
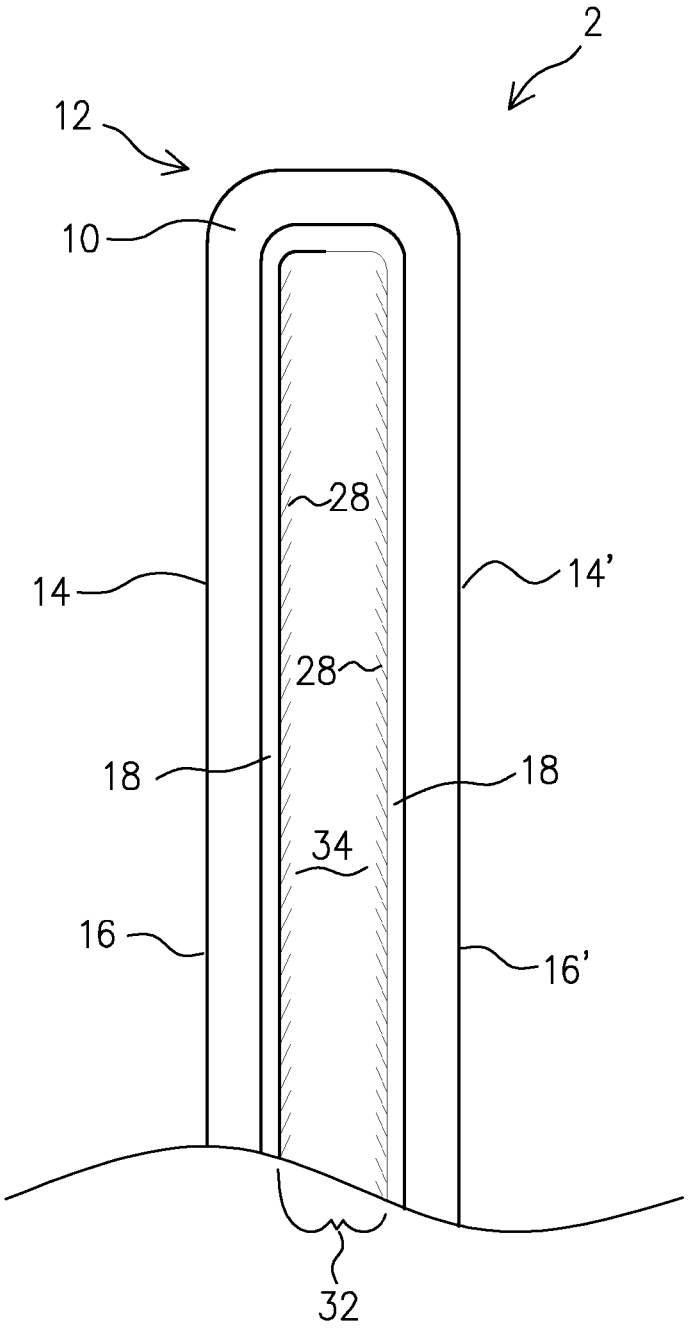
FIG. 2 is a side, cross-sectional, exploded, partial view drawing of the inventive Anti-Slip Electronic Device Sleeve showing internal opposing layers of material with a stiff directional nap, according to the invention.

FIG. 2 shows a cross-sectional, exploded, partial view of the inventive Anti-Slip Electronic Device Sleeve 2 showing enlarged (not drawn to scale) internal opposing layers of material 18 with a stiff directional nap 28. As shown in FIG. 2, the depth 32 of the pocket opening 34 is configured to generally conform to the depth of the device 22 (shown in FIG. 1) inserted therein for a snug fit. The stiff directional nap 28 is angled at an approximate 45 degree angle from the base material 18. The angle of the nap 28 permits quick slidable insertion of the device 22 (shown in FIG. 1) into the sleeve's pocket 34. The device glides easily into the pocket 34. However, upon positioning of the pocket 34 in a downward direction, as shown in FIG. 1, a portion of the stiff directional nap 28 is inclined against the nap's natural or fixed direction, in a greater than 45 degree angle against the sides of the device 22, thereby retaining the device within the sleeve 2 against the force of gravity. In other words, the angle of the directional nap 28 allows the device 22 to glide into the pocket 34 with minimal resistance, and thereafter prevents the device 22 from falling out of the pocket 34. The material 18 is preferably lint brush or directional nap fabric, and is typically constructed from a polyester/cotton mix, but may be any suitable or desired types of material with a stiff directional nap or combinations thereof, including without limitation, a molded or formed plastic.

Figures 3A, 3B, 3C:
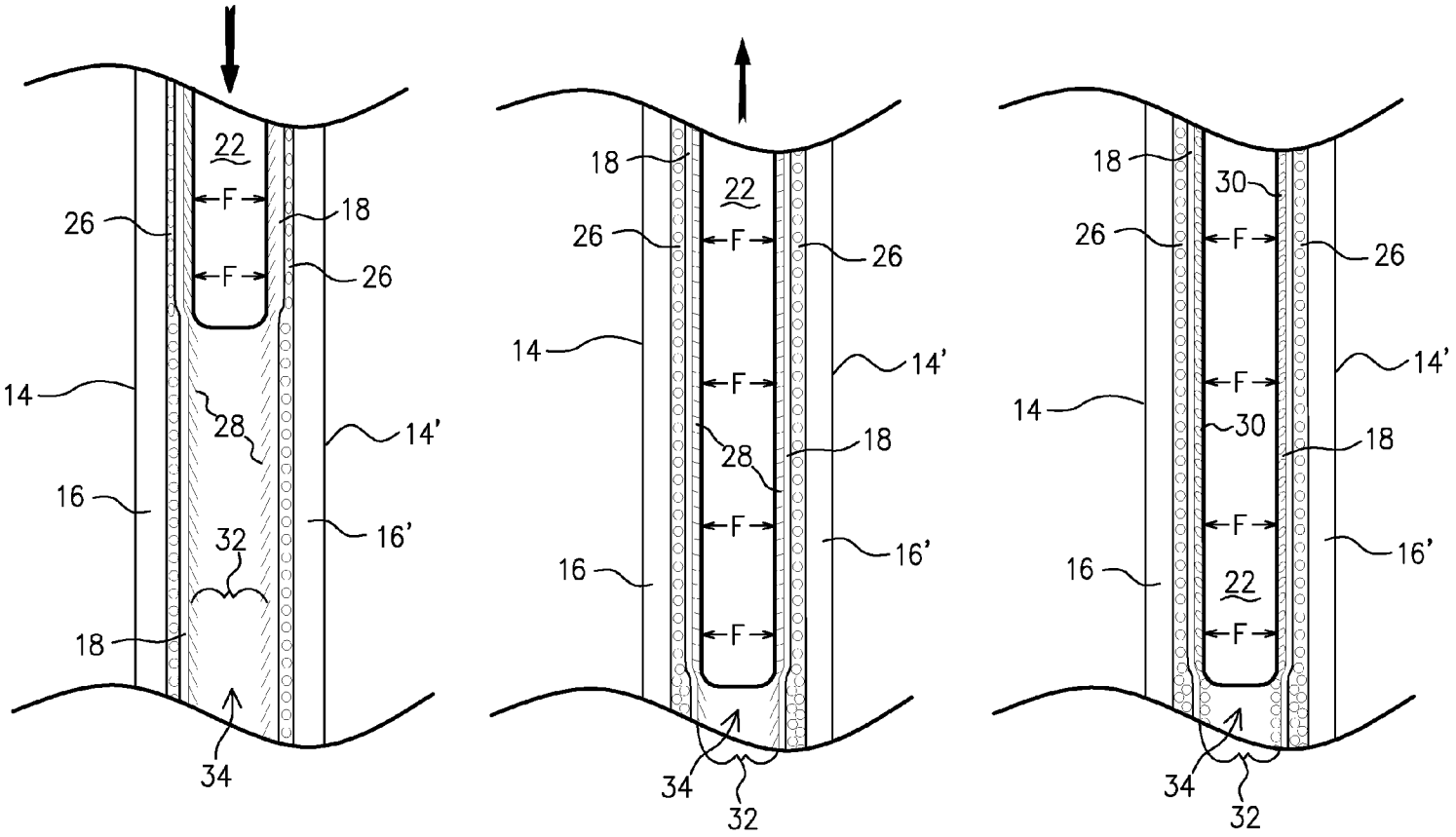
FIG. 3A is a side, cross-sectional, exploded, partial view drawing of the inventive Anti-Slip Electronic Device Sleeve showing an exemplary electronic device being slidably inserted within a sleeve having layers of opposing material with a stiff directional nap and opposing foam layers.
FIG. 3B is a side, cross-sectional, exploded, partial view drawing of the inventive Anti-Slip Electronic Device Sleeve showing an exemplary electronic device being slidably removed from a sleeve having layers of opposing material with a stiff directional nap and opposing foam layers; and, FIG. 3C is a side, cross-sectional, exploded, partial view drawing of the inventive Anti-Slip Electronic Device Sleeve showing an exemplary electronic device inserted within a sleeve having internal layers of material with a urethane-coated stiff directional nap.

FIGS. 3A-3C show cross-sectional, exploded (not drawn to scale), partial views of the inventive Anti-Slip Electronic Device Sleeve 2. FIG. 3A shows an exemplary electronic device 22 being slidably inserted within a pocket 34 defined by layers of opposing material 18 with a stiff directional nap 28. Referring to FIG. 3A, additional resilient foam layers 26 are laminated to the back side of the external fabric 16/16' and inserted between the material 18 having a stiff directional nap 28, on the one hand, and the external fabric 16/16', on the other hand. The foam 26 is compressed (see arrows "F") by the device 22 as it is slidably inserted within the pocket 34. The resilient qualities of the compressed foam 26 in turn cause the foam to push against the material with a stiff directional nap 18, thereby providing contact friction forces "F" between the directional nap 28, on the one hand, and the external smooth faces of the device 22, on the other hand. The foam 26 compression helps provide a snug, but not overly-tight, fit for the electronic device 22 retained within the pocket 34.

FIG. 3B shows an exemplary electronic device 22 at an initial moment of removal from the pocket 34. As shown in FIG. 3B, the directional nap 28 is forced or inclined to a greater than 45 degree angle when engaged against the device 22 in a removal direction. The directional nap 28 pushes against the smooth faces of the device 22, in part due to the opposing friction forces ("F") generated by the compressed foam layers 26.

FIG. 3C shows an alternate embodiment for the material 18 with a stiff directional nap comprising coated directional nap 30. As shown in FIG. 3C, the directional nap 30 may be treated or coated with one or more friction-enhancing materials to attain a better grip on the smooth device 22. The coating may be applied to one side of the nap 30 (such as the side of the nap that comes into contact with the device 22), or both sides of the nap, as suitable or desired. The coating may be polyurethane-based or any other suitable or desired coating material or layers of materials that increase the static friction forces between the directional nap, on the one hand, and the smooth external contours of the device, on the other hand.

In use, as described in connection with FIG. 1, supra, the device 2 is manually slid into the slot opening 6 at the first end 8 of the sleeve 2. When the sleeve 2 is turned upside down, the stiff directional nap 18 engages the smooth contours and smooth faces of the device 22 and retains the device 22 within the sleeve 2. The device 22 does not fall out the opening 6 at the top of the sleeve 8 when the sleeve 2 containing the device 22 is held upside down, even when the sleeve 2 is gently shaken along a vertical axis in a downward direction.

Referring to FIG. 1 and FIG. 3B, to remove the device 22 from within the sleeve 2, a user 24 may insert a thumb and index finger of one hand to pinch the device 22 and commence pulling the device 22 out of the slot opening 6. The slight pulling action overcomes the friction forces between the directional nap 28 and the faces of the device 22 and permits easy, slidable removal of the device 22 out of the sleeve 2. In addition to the pinching action, or alternately, to remove the device 22 from within the sleeve 2, a user 24 may pinch the side margins 14/14' of the sleeve 2 to physically separate the nap 28 from the device 22, and thereby overcome the static friction forces.

INDUSTRIAL APPLICABILITY

It is clear that the inventive Anti-Slip Electronic Device Sleeve of this application has wide applicability to the electronic industry, namely to provide a protective sleeve for electronic devices that allows for quick and easy access to the device, while simultaneously ensuring the safety of the device when the sleeve is held in a downward direction. With the growth in use of hand-held personal electronic devices, there is an increasing need for sleeves that combine quick access with device protection.

It should be understood that various modifications within the scope of this invention can be made by one of ordinary skill in the art without departing from the spirit thereof and without undue experimentation. For example, the sleeve may incorporate additional features such as attachment rings, key rings, carabiner clips, attachment clips, spring clips, belt clips, and the like. Any suitable or desired material may be used in lieu of the fabric-based external layers, including durable, hard materials. External pockets, external zippered pockets, and the like may be added to the external layers. The shape of the sleeve may conform to any suitable or desired size or shape of internal device. The slot opening may incorporate tabs, hook and loop fasteners, buttons, snaps, or any other closure mechanisms as desired. Multiple layers of internal foam of different types may be utilized; alternately, a clamp or bracket of spring steel, rigid plastic or similar material may be used to maintain engagement of the napped surface and the device. Directional nap of differing lengths and thicknesses may be utilized, and/or the internal layer may comprise select strips or other partial portions of material with a stiff directional nap as opposed to continuous, uninterrupted nap. The sleeve may be sewn to or otherwise adhered to another carrying item, such as a purse or laptop case, as opposed to being hand-held, thus creating an integrated pocket rather than a separate pouch/case. This invention is therefore to be defined as broadly as the prior art will permit, and in view of the specification if need be, including a full range of current and future equivalents thereof.

I claim:

1. A sleeve for an electronic communication device having a defined shape and generally smooth external contoured faces and edges, the sleeve comprising:

a top margin defining a first slot opening on a first end, a closed base margin on an opposing second end, and side walls generally spanning the first and second ends, said walls having an internal defined length;

wherein the sleeve is constructed primarily of one or more fabrics, said fabrics comprising a first external layer of material and a second internal layer of material;

wherein a maximum width of the slot opening, a maximum depth of the slot opening, and the internal defined length of the side walls generally conform to the defined shape of the device and define a pocket shaped for slidable insertion and removal of the device from within the pocket;

wherein the second internal layer of the material comprises a stiff directional nap capable of engaging the smooth contoured faces and edges of the device inserted within the sleeve.

2. The sleeve of claim 1, further comprising at least one layer of foam between the first external layer of material and the second internal layer of material.

3. The sleeve of claim 1, wherein the nap comprises a coating.

4. The sleeve of claim 1, wherein the nap comprises a coating of polyurethane.

5. The sleeve of claim 1, wherein the second internal layer comprises a lint brush material.

6. The sleeve of claim 1, wherein the second internal layer is constructed from a material with a continuous stiff directional nap.

7. The sleeve of claim 1, wherein a portion of the second internal layer is constructed from a material with a stiff directional nap.

8. The sleeve of claim 1, wherein the second internal layer comprises a material with a stiff directional nap of differing lengths and thicknesses.

9. The sleeve of claim 1, wherein the electronic communication device is selected from the group consisting of: cell phone, smart phone, media player, tablet computer.

10. The sleeve of claim 1, further comprising an attachment device selected from the group consisting of: attachment ring, key ring, carabiner clip, spring clip, belt clip.

11. The sleeve of claim 1, further comprising an external pocket.

12. The sleeve of claim 1, wherein the slot opening further comprises a closure mechanism selected from the group consisting of: tabs, hook and loop fasteners, buttons, snaps.

13. The sleeve of claim 1, further comprising multiple foam layers.

14. The sleeve of claim 1, adhered to another carrying item.

15. The sleeve of claim 1, wherein removal of the device by a user overcomes a static friction force between the second internal layer and the external faces and edges of the device, said static friction force otherwise capable of retaining the device within the pocket against a force of gravity when the slot opening of the sleeve is positioned in a downward direction.

* * * * *